US009220962B2

(12) United States Patent
Van Nguyen et al.

(10) Patent No.: US 9,220,962 B2
(45) Date of Patent: Dec. 29, 2015

(54) DOUBLE WALL BAT AND PROCESS FOR MANUFACTURING SAME

(71) Applicants: Thu Van Nguyen, West Hills, CA (US); Chi-Hung Lee, Fujian (CN); Renqin Zhang, Fujian (CN)

(72) Inventors: Thu Van Nguyen, West Hills, CA (US); Chi-Hung Lee, Fujian (CN); Renqin Zhang, Fujian (CN)

(73) Assignee: Thu Van Nguyen, West Hills, CA (US)

( * ) Notice: Subject to any disclaimer, the term of this patent is extended or adjusted under 35 U.S.C. 154(b) by 15 days.

(21) Appl. No.: 14/101,033

(22) Filed: Dec. 9, 2013

(65) Prior Publication Data

US 2015/0157908 A1 Jun. 11, 2015

(51) Int. Cl.
*A63B 59/06* (2006.01)
*A63B 59/00* (2015.01)

(52) U.S. Cl.
CPC ..... *A63B 59/00* (2013.01); *A63B 59/06* (2013.01); *A63B 60/54* (2015.10); *A63B 2102/18* (2015.10); *A63B 2102/182* (2015.10); *A63B 2209/00* (2013.01)

(58) Field of Classification Search
CPC ..... A63B 59/06
USPC ..... 473/457, 519, 520, 564–568
See application file for complete search history.

(56) References Cited

U.S. PATENT DOCUMENTS

| | | | | |
|---|---|---|---|---|
| 1,611,858 | A | 12/1923 | Middlekauff | |
| 3,861,682 | A * | 1/1975 | Fujii | 473/520 |
| 4,323,239 | A * | 4/1982 | Ishii | 473/566 |
| 5,626,050 | A | 5/1997 | Ploughe | |
| 5,899,823 | A * | 5/1999 | Eggiman | 473/566 |
| 5,954,602 | A * | 9/1999 | Eggiman | A63B 49/08 473/566 |
| 6,334,825 | B1 * | 1/2002 | Buiatti | 473/566 |
| 6,461,260 | B1 * | 10/2002 | Higginbotham | 473/566 |
| 6,485,382 | B1 * | 11/2002 | Chen | 473/566 |
| D476,709 | S | 7/2003 | Nguyen | |
| 6,702,698 | B2 * | 3/2004 | Eggiman et al. | 473/566 |
| 6,735,998 | B2 | 5/2004 | Mitchell | |
| 6,808,464 | B1 | 10/2004 | Nguyen | |
| 7,201,679 | B2 | 4/2007 | Nguyen | |
| 7,328,599 | B2 | 2/2008 | Van Nguyen | |
| 7,344,461 | B2 | 3/2008 | Van Nguyen | |
| 7,377,866 | B2 | 5/2008 | Van Nguyen | |
| 7,381,141 | B2 | 6/2008 | Van Nguyen | |
| 7,419,446 | B2 | 9/2008 | Nguyen | |
| 7,585,235 | B2 * | 9/2009 | Misono et al. | 473/567 |
| 8,197,365 | B2 * | 6/2012 | Tokieda | 473/566 |
| 8,512,176 | B1 * | 8/2013 | Mathew et al. | 473/567 |
| 8,747,262 | B1 * | 6/2014 | Lin et al. | 473/566 |
| 8,814,733 | B2 * | 8/2014 | Tsukamoto et al. | 473/566 |
| 2002/0091022 | A1 * | 7/2002 | Fritzke et al. | 473/566 |
| 2007/0202973 | A1 * | 8/2007 | Van Nguyen | 473/564 |
| 2008/0085792 | A1 * | 4/2008 | Sims et al. | 473/564 |
| 2009/0280934 | A1 * | 11/2009 | Watari et al. | 473/566 |
| 2010/0087282 | A1 * | 4/2010 | Smith | 473/566 |
| 2012/0108371 | A1 | 5/2012 | Epling et al. | |
| 2014/0073464 | A1 * | 3/2014 | Van Nguyen | 473/566 |

* cited by examiner

*Primary Examiner* — Mark Graham
(74) *Attorney, Agent, or Firm* — Kelly & Kelley, LLP

(57) ABSTRACT

A multi-section ball bat includes a barrel, a handle and an end cap. The handle has a first end defining a grip portion and a generally opposite second end attached to the barrel. The end cap has a first end attached to an opposite end of the barrel. At least a portion of the handle may have a multi-wall configuration defined by a gap. Similarly, at least a portion of the end cap may have a multi-wall configuration defined by a gap. The gap in a wall of the handle or the end cap may be formed between layers of a multi-layer composite material forming the handle or end cap. The presence of the gap in the handle or end cap extends the sweet spot of the bat from the barrel into the handle and/or the end cap.

17 Claims, 10 Drawing Sheets

DOUBLE WALL BAT AND PROCESS FOR MANUFACTURING SAME

BACKGROUND OF THE INVENTION

The present invention generally relates to ball bats, such as baseball and softball bats. More particularly, the present invention relates to a sectional ball bat, at least a portion of which has a double wall configuration.

Baseball and softball are very popular sports in the United States and many other countries. Due to the competitive nature of these sports, players are constantly seeking ways of improving their performance. An important aspect of baseball and softball is the ability to effectively hit the ball.

Metal (aluminum) bats are allowed in baseball amateur play from Little League to College levels. Metal bats are also typically used in slow and fast pitch softball. Metal bats are advantageous over wood bats in that they do not break and splinter like wood bats and thus can be used repeatedly with consequent cost savings.

However, metal bats have certain disadvantages, including vibrating upon impact and sending painful vibrations into the hands and arms of the batter if the ball is not hit within the "sweet spot" of the bat. Metal bats, particularly aluminum bats, may also dent or otherwise deform due to forceful impacts with the ball. Metal bats also emit an undesirable high-pitched metallic sound, as opposed to the traditional sound heard when a wood bat contacts the ball.

Various attempts have been made to overcome the problems associated with metal bats, including coating or wrapping the exterior of the metal bat with material such as carbon reinforcing fibers to enhance batting performance. Other attempts have been made to insert internal layers or compartments within the metal bat to improve performance. Bats that incorporate composite materials tend to be much lighter than metal bats. However, while providing benefits, these designs also have drawbacks in that they can be expensive to manufacture and are prone to structural failure.

Notwithstanding the disadvantages of metal and composite bats, these bats are very popular at the amateur level as not only can they be used repeatedly with consequent cost savings, but they also have a larger "sweet spot" hitting area or power zone than wood bats. Furthermore, the ball comes off a metal bat faster than a wood bat, resulting in longer hits.

In fact, over the years there have been many injuries and near misses attributed to the speed from which the ball comes off a metal and/or composite bat. In order to address these concerns, the NCAA (National Collegiate Athletic Association) and NFHS (National Federation of High School Association) instituted a standard which is referred to as the BBCOR Bat Standard, or the Batted-Ball Coefficient of Restitution, sometimes referred to as Bat-Ball Coefficient of Restitution. BBCOR measures the "bounciness" of the ball and bat or the "trampoline" effect. A pitched ball holds a lot of energy, and with solid wood bats much of that energy is lost as the ball compresses on impact. With hollow metal and composite bats, the ball distorts less, retaining its pitched energy, and adds to it the power of the bat speed. Hence, traditionally non-wood bats have hit balls faster. BBCOR is calculated using the inbound and rebound speeds of the ball. The loss of energy at impact is what BBCOR measures, and the new standard ensures that performances by non-wood bats are more comparable to those of wood bats. In order to meet the standard, the BBCOR must be less than or equal to 0.500.

Accordingly, there is a continuing need for a ball bat which overcomes the deficiencies of traditional wood bats, while incorporating the advantages of metal and composite material bats while enlarging or maximizing the "sweet spot" of the bat. What is also needed is such a bat which meets the BBCOR standard. The present invention fulfills these needs, and provides other related advantages.

SUMMARY OF THE INVENTION

The present invention relates to a ball bat, such as a baseball or softball bat, having a multi-wall configuration along at least one or more regions thereof. In a particularly preferred embodiment, the bat is comprised of multiple sections which may be comprised of differing materials.

The bat generally comprises a barrel having opposite first and second ends. A handle has a first end defining a grip portion and a generally opposite second end which is attached to the first end of the barrel. An end cap has a first end attached to the second end of the barrel. The barrel, handle, and end cap may be comprised of a metal or a composite material or combinations thereof.

At least a portion of the handle may have a multi-wall configuration defined by a gap. The gap in the portion of the handle having the multi-wall configuration is typically annular and is disposed adjacent to the second end of the handle. The handle may be comprised of a multi-layer composite material, and the gap in a wall of the handle is formed between layers of the composite material.

A portion of the handle adjacent to the second end thereof is insertable into the first end of the barrel, such that the handle and the barrel are coaxial. The second end of the handle and the first end of the barrel may be of reduced outer diameter, such that interconnection of the handle and barrel provides a generally continuous exterior surface. The handle may include an annular recess configured to receive the first end of the barrel therein.

At least a portion of the end cap may have a multi-wall configuration defined by a gap. The end cap may be comprised of a multi-layer composite material, and the gap in a wall of the end cap is formed between layers of the composite material. The gap in the portion of the end cap having the multi-wall configuration is generally annular in configuration and disposed adjacent to the first end of the end cap.

A portion of the end cap adjacent to the first end thereof is insertable into the second end of the barrel such that the end cap and the barrel are coaxial. The first end of the end cap and the second end of the barrel may be of reduced outer diameter, such that interconnection of the end cap and barrel provides a generally continuous exterior surface. The end cap may include an annular recess configured to receive the second end of the barrel therein.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

As shown in the accompanying drawings, for purposes of illustration, the present invention resides in a ball bat, generally referred to by the reference number 10. The bat 10 is typically a baseball or softball bat, but can comprise other bats in which a ball is to be hit. As will be more fully explained herein, the bat 10 of the present invention has an enlarged sweet spot or effective hitting area. The bat 10 is comprised of multiple sections, which may be comprised of the same or different materials.

Figure 1:
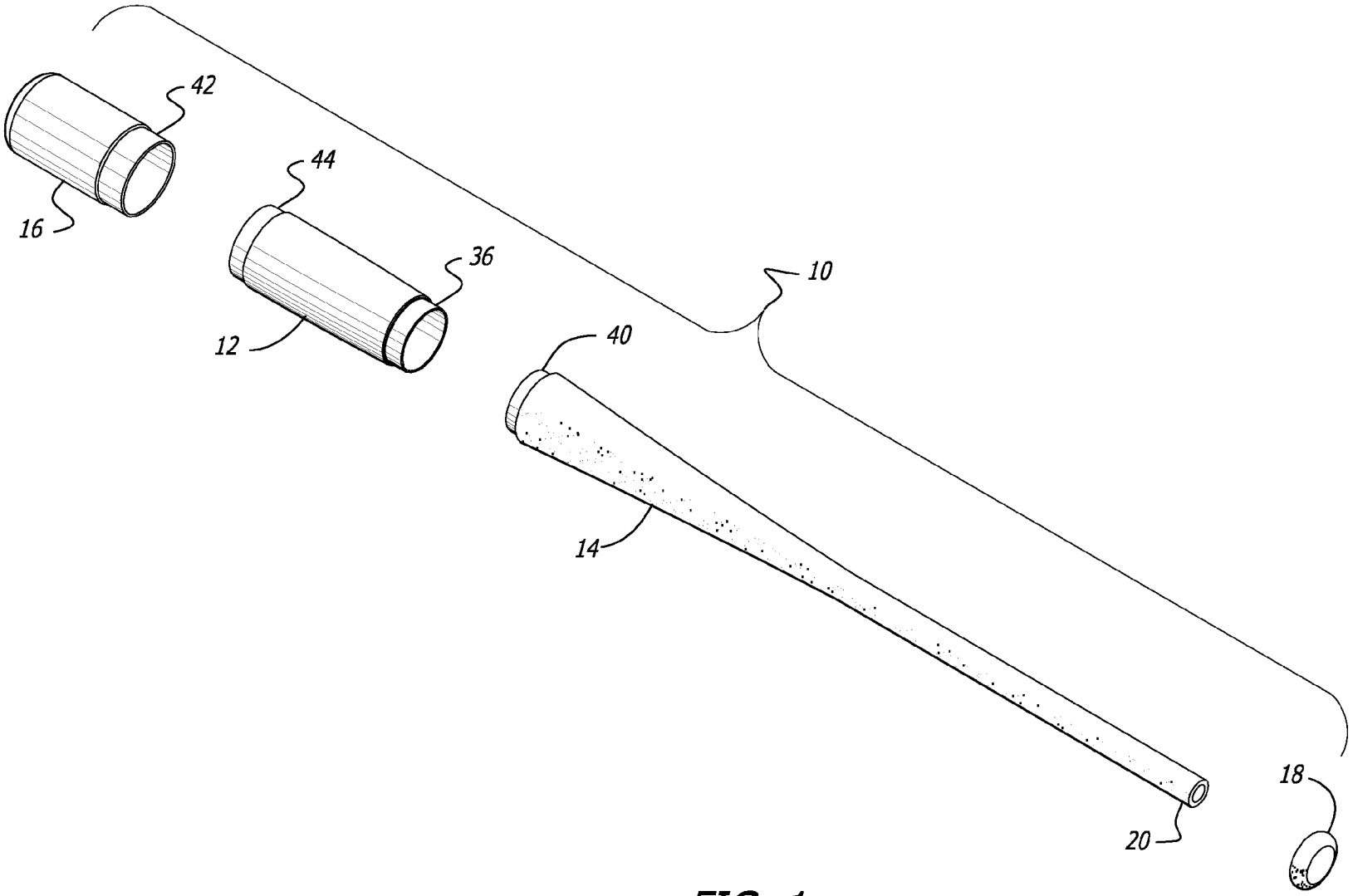
FIG. 1 is an exploded perspective view of components comprising the bat of the present invention.

With reference now to FIG. 1, the bat 10 is comprised of a barrel section 12 which is attached to a handle section 14 and an end cap section 16. Typically, a knob 18 is attached to a first end 20 of the handle.

Figure 2:
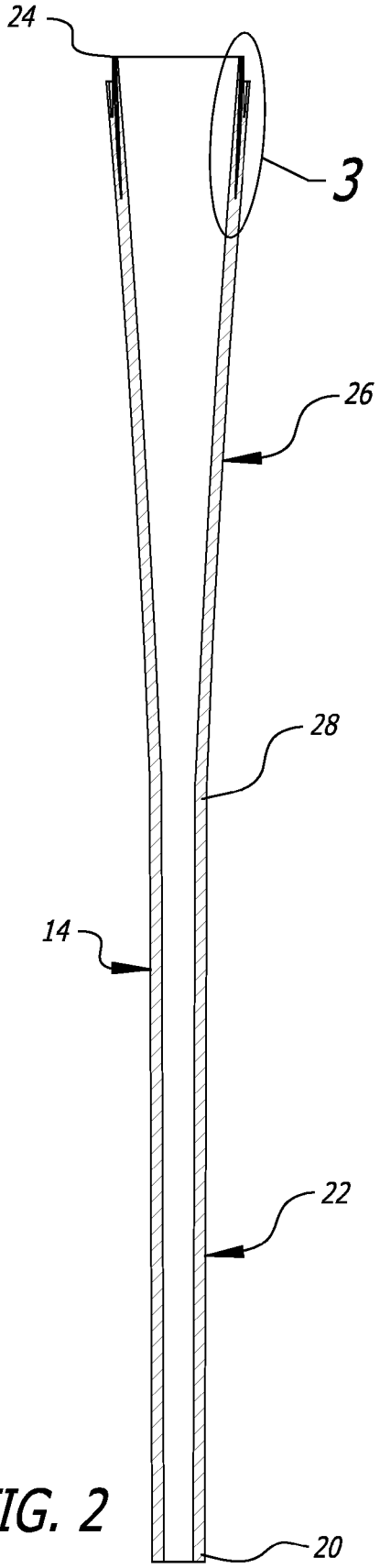
FIG. 2 is a cross-sectional view of a handle of the bat.
Figure 3:
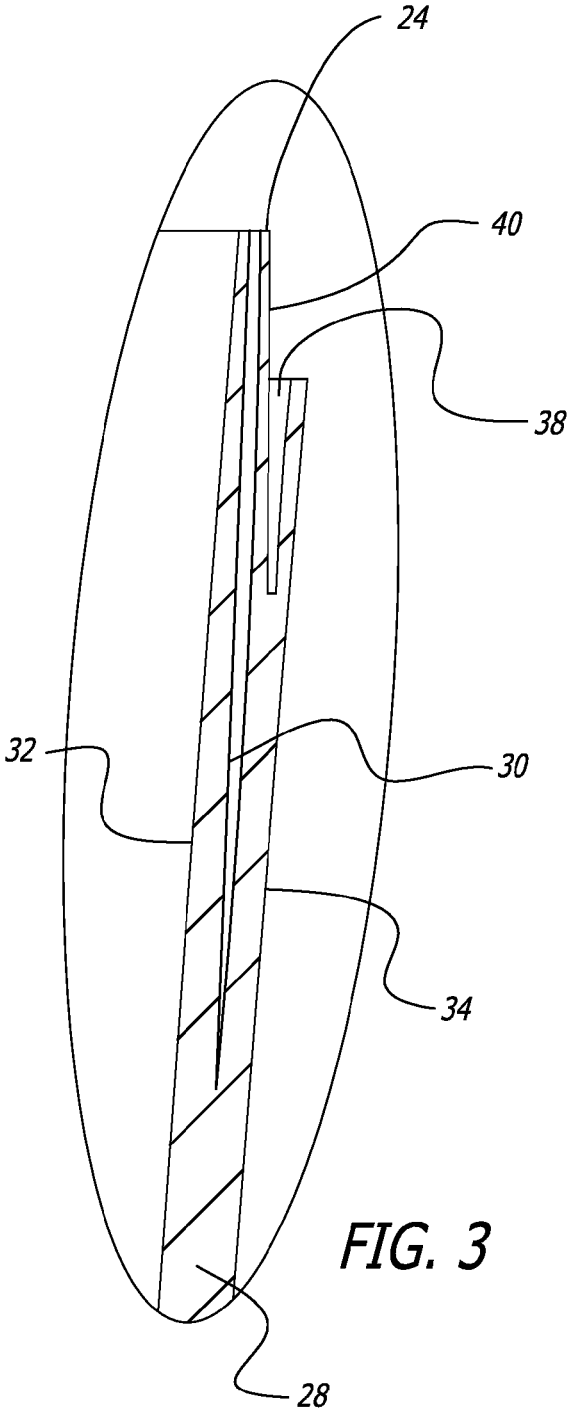
FIG. 3 is an enlarged sectional view of area "3" of FIG. 2, illustrating a gap formed in a portion of the wall of the handle and an annular recess for receiving an end of the barrel.

With reference now to FIGS. 1-3, the handle section 14 includes a first free end 20, to which the knob 18 is typically attached. The handle section 14 may be comprised of any suitable material, such as wood or metal, including aluminum alloys, a titanium alloy, a steel, or other metallic alloys. However, more typically the handle section 14 is comprised of a composite material, such as fiber composite material, a thermoplastic material, a thermoset material, and combinations thereof. In a particularly preferred embodiment, the handle section 14 is comprised of a multi-layer composite material. In a region adjacent to the first end 20 of the handle 14 is a grip portion 22. The grip portion 22 may be covered with a suitable grip material (not shown) to enhance the comfort and frictional gripability of the grip portion 22 of the handle section 14. Towards a second end 24 of the handle section 14 is a generally tapered region 26. It will be understood, however, that this intermediate tapered region 26 could also be formed as part of the barrel section 12. Typically, as illustrated, the barrel section 12 is generally hollow, tubular and cylindrical. The handle section 14 tapers from an outer diameter substantially matching the barrel's diameter at the end 24 to a much narrower outer diameter at the grip portion 22.

As illustrated in FIGS. 2 and 3, a length of the handle section 14 is comprised of a single wall 28. By "single wall", it is intended to refer to the fact that although the wall 28 may be multi-layered, it is generally solid from the inner surface thereof to the outer surface thereof without any gaps or voids. However, as illustrated in FIG. 3, a gap or void 30 is formed in the handle section 14, which gap 30 creates a void between segments of the wall 28 so as to create two walls 32 and 34 on either side of the gap or void 30. While a single gap or void 30 is illustrated, creating two walls 32 and 34, it will be appreciated that it is contemplated by the present invention that multiple gaps or voids may be incorporated creating multiple spaced-apart wall arrangements.

Figure 6:
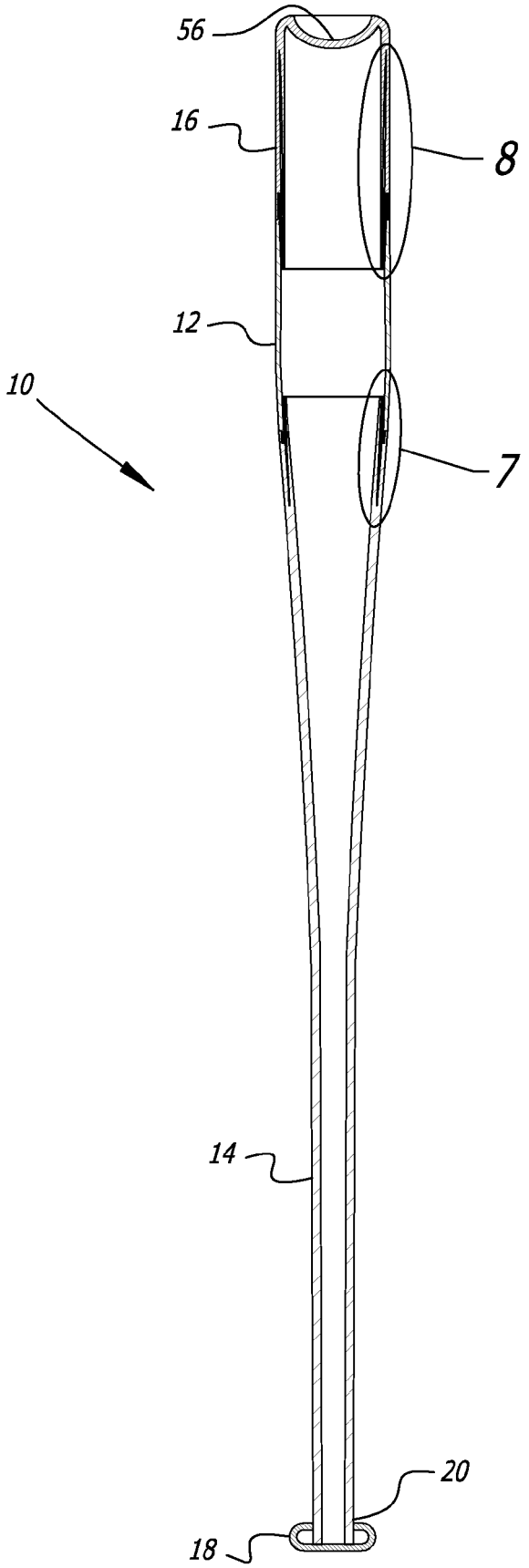
FIG. 6 is a cross-sectional view of an assembled bat embodying the present invention.
Figure 7:
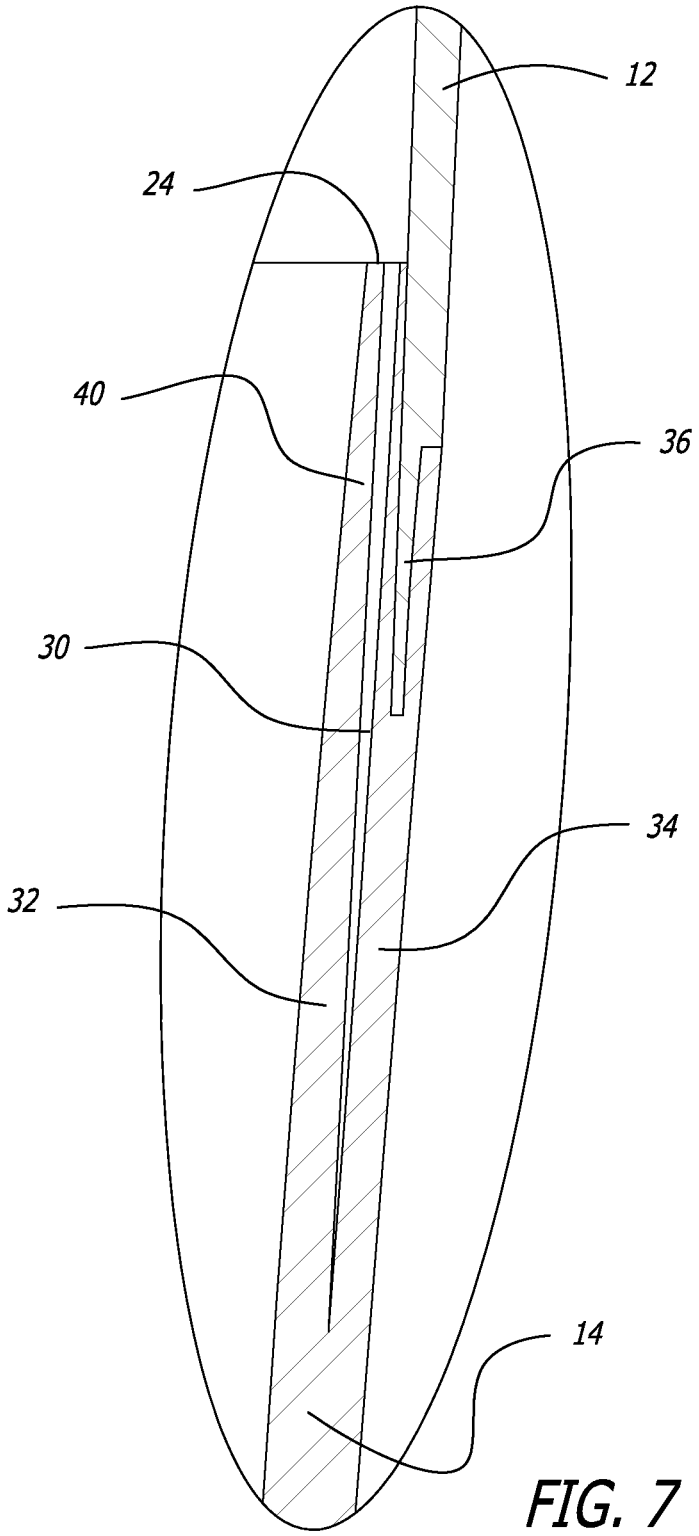
FIG. 7 is an enlarged cross-sectional view of area "7" of FIG. 6, illustrating the interconnection of the barrel and handle, in accordance with the present invention.

As illustrated in FIGS. 2 and 3, the portion or region of the handle 14 having the multi-wall configuration is adjacent to the second end 24 of the handle so as to be adjacent to or overlap a portion of the barrel section 12 when interconnected, as illustrated in FIGS. 6 and 7. The gap 30 in the portion of the handle 14 having the multi-wall configuration is typically generally annular in configuration such that the entirety of the region adjacent to the second end 24 of the handle section 14 is of a multi-wall configuration. It should be understood that the length of the portion or of the region of the handle 14 having the multi-wall configuration, or in other words the one or more gaps 30, can vary in length. For example, the length can vary from less than one inch to several inches or more. In fact, the portion or region of the handle 14 having the multi-wall configuration can extend to nearly an entire length of the handle section 14. Alternatively, the length of the gap 30 or of the multi-wall configuration section can be much less, such as only several inches in length or even less than an inch in length.

As used herein, the term "composite material" can refer to a fiber composite material, such as a plurality of fibers impregnated, or permeated throughout, with a resin. The fibers can be co-axially aligned in sheets or layers, braided or weaved in sheets or layers, and/or chopped and randomly dispersed in one or more layers. The composite material may be formed of a single layer or multiple layers comprising a matrix of fibers impregnated with resin. The layers may be separated, at least partially by use of a scrim, veil, a release layer applied during the application of the multiple layers of composite material, etc. in order to create the gap or void 30 between the layers. The creation of this gap or void 30, thus creating a multi-wall arrangement, such as the illustrated walls 32 and 34, has been found to create a trampoline effect, such that if a ball is struck by the bat 10 at the region having the multi-wall configuration, which is traditionally outside of the sweet spot, the ball is more effectively hit than if the ball were to strike a portion of the handle 14 outside of the multi-wall configuration portion.

Figure 4:
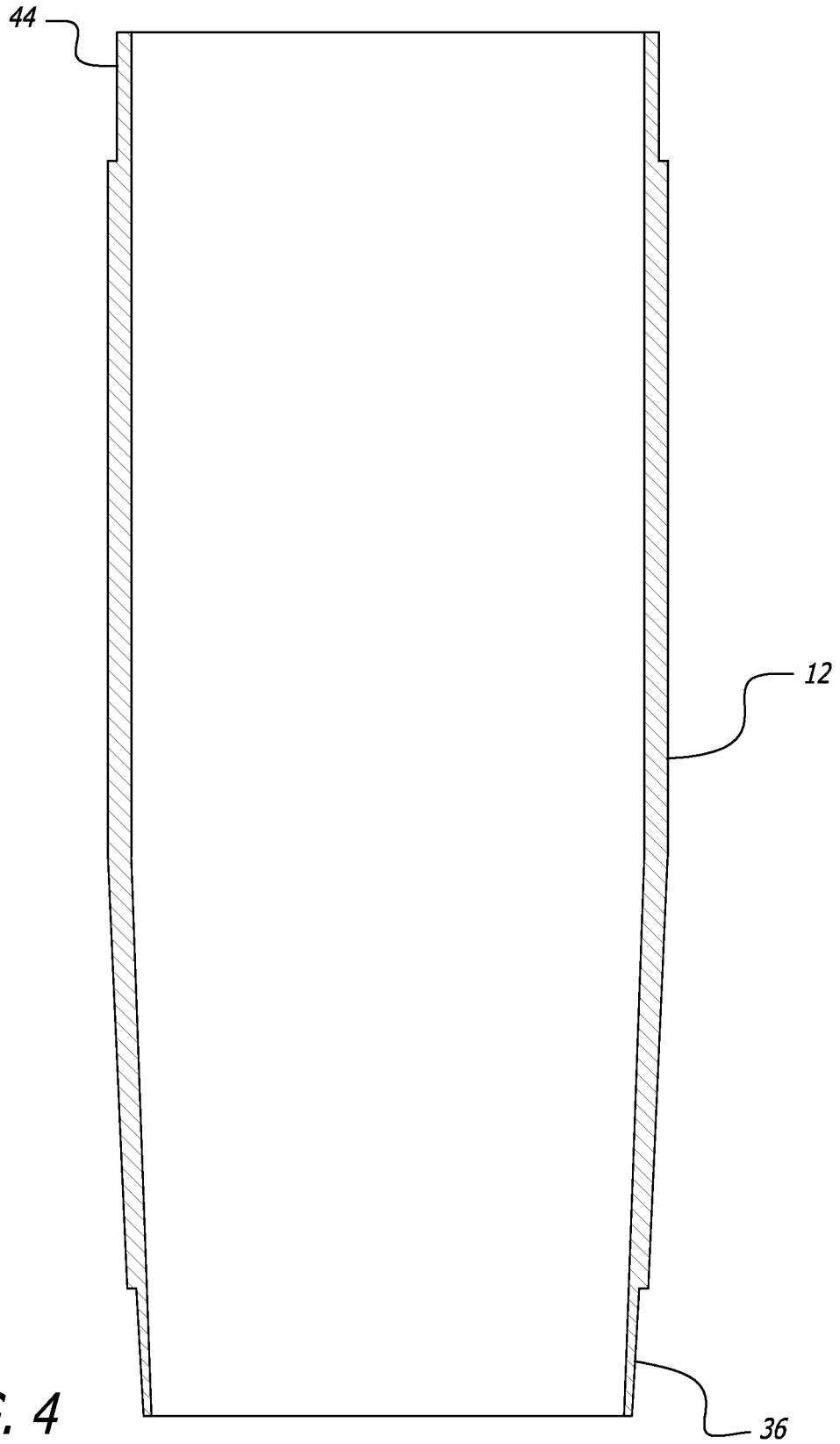
FIG. 4 is a cross-sectional view of a barrel used in accordance with the present invention.

With reference now to FIG. 4, the barrel 12 is typically hollow and of a tubular and cylindrical configuration. The barrel 12 may be comprised of a composite material, but more typically is comprised of a metal, such as an aluminum or titanium alloy or the like. The wall forming the barrel section 12 may be of a single layer, multi layers, and of a single thickness or varying thickness. Typically, the barrel section 12 does not have a gap or a void within the wall thereof. Instead, the material of the barrel section 12, and the thickness thereof, are of characteristics so as to create an effective hitting area or sweet spot along substantially a length thereof when a ball is struck at the barrel section 12 area of the bat 10. Furthermore, preferably, the material and thickness and other characteristics are such so as to resist denting, cracking and other damage when hitting baseballs or softballs or the like during normal use.

A first end 36 of the barrel section 12 is attachable to the second end 24 of the handle section 14. This may be done in a variety of ways. The interconnection may be by adhesive, mechanical, or combinations thereof. Preferably, the interconnection of the handle 14 and barrel 12 provides a generally continuous exterior surface. When interconnected, the handle 14 and barrel 12 are coaxial.

With reference to FIGS. 3, 4 and 7, in the illustrated embodiment, a region adjacent to the first end 36 of the barrel 12 is of a reduced outer diameter. The handle 14 includes an annular recess 38 which is sized and configured so as to receive the reduced diameter open end 36 of the barrel 12 therein. A region or segment 40 of the handle 14 adjacent to the second end 24 thereof is of a reduced diameter so as to be inserted into the barrel 12, as illustrated in FIGS. 6 and 7. In this manner, the gap or void 30 partially overlaps the lower region of the barrel section 12, as illustrated in FIG. 7. Adhesive may be applied to the reduced diameter section 36 of the end of the barrel 12 so that a permanent connection is made between the barrel 12 and the handle 14 when the reduced diameter end 36 is inserted into the annular recess 38 of the handle 14.

Figure 5:
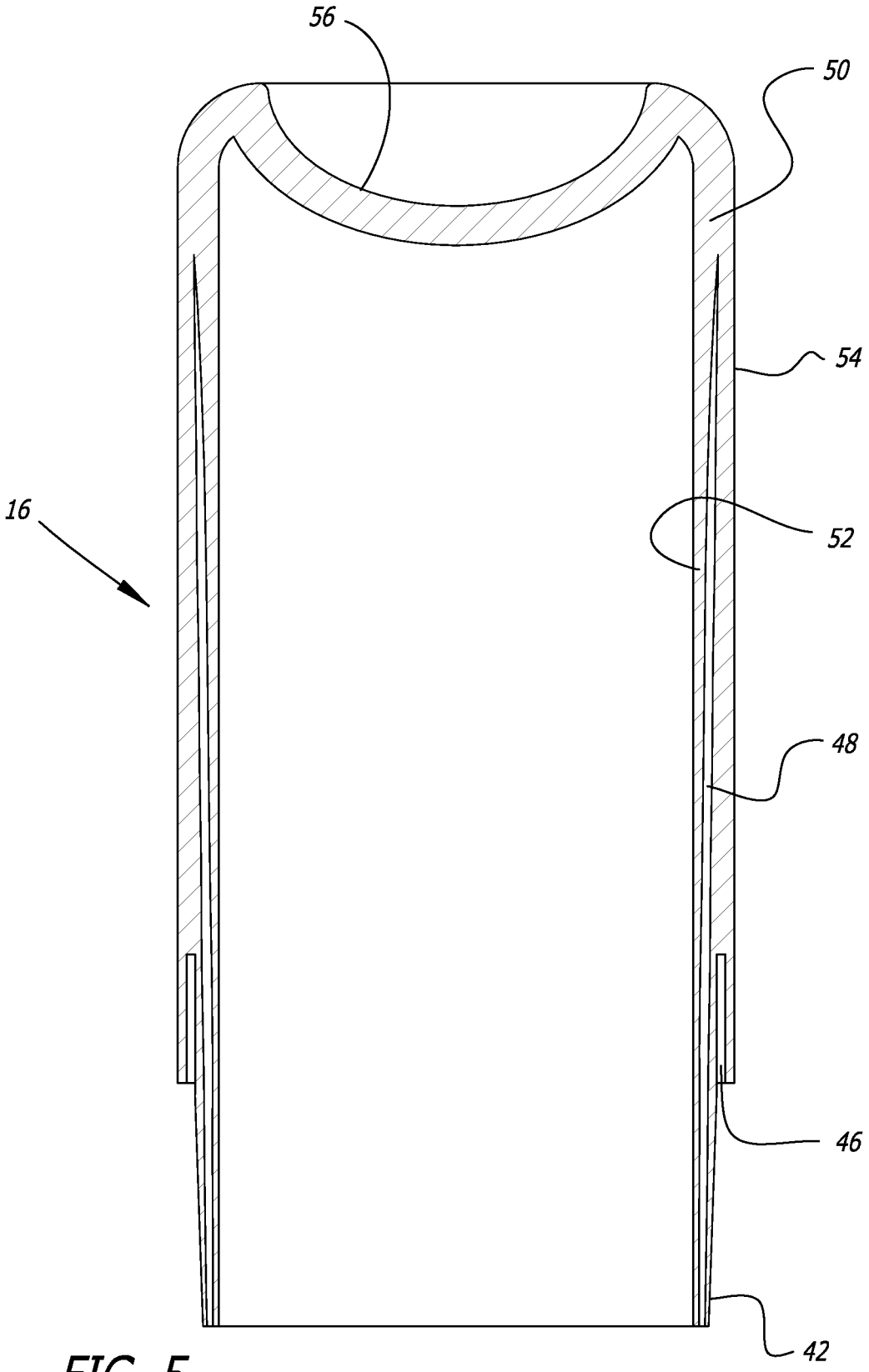
FIG. 5 is a cross-sectional view of an end cap used in accordance with the present invention, and illustrating a gap formed in a wall thereof, and an annular recess configured to receive an end of the barrel therein.

With reference now to FIG. 5 the end cap section 16 may also be comprised of any suitable material, including wood, a metal, including alloys thereof, etc. However, the end cap 16 is typically comprised of a composite material, similar to the handle, as described above. A first end 24 of the end cap 16 is attachable to a second end 44 of the barrel 12. Such connection can be made by means of adhesive, mechanical interconnection, or combinations thereof. Preferably, the interconnection of the barrel 12 and the end cap 16 provides a generally continuous exterior surface. The interconnection also makes the end cap 16 and barrel 12 coaxial to one another.

Similar to that described above, in the illustrated embodiment, the second end 44 of the barrel 12 is of a reduced diameter. The end cap 16 includes an annular recess 46 which is sized and configured so as to receive the reduced diameter end portion 44 of the barrel 12 therein. Adhesive may be applied to the exterior surface of the second end portion 44 of the barrel 12 before insertion into the annular recess 46 of the end cap 16 so as to create a permanent attachment thereto. When the second end 44 of the barrel section 12 is inserted into the annular recess 46, which is spaced from the end 42 of the end cap 16, the exterior surfaces of the end cap 16 and the barrel 12 are substantially continuous, as illustrated in FIGS. 6 and 8.

Figure 8:
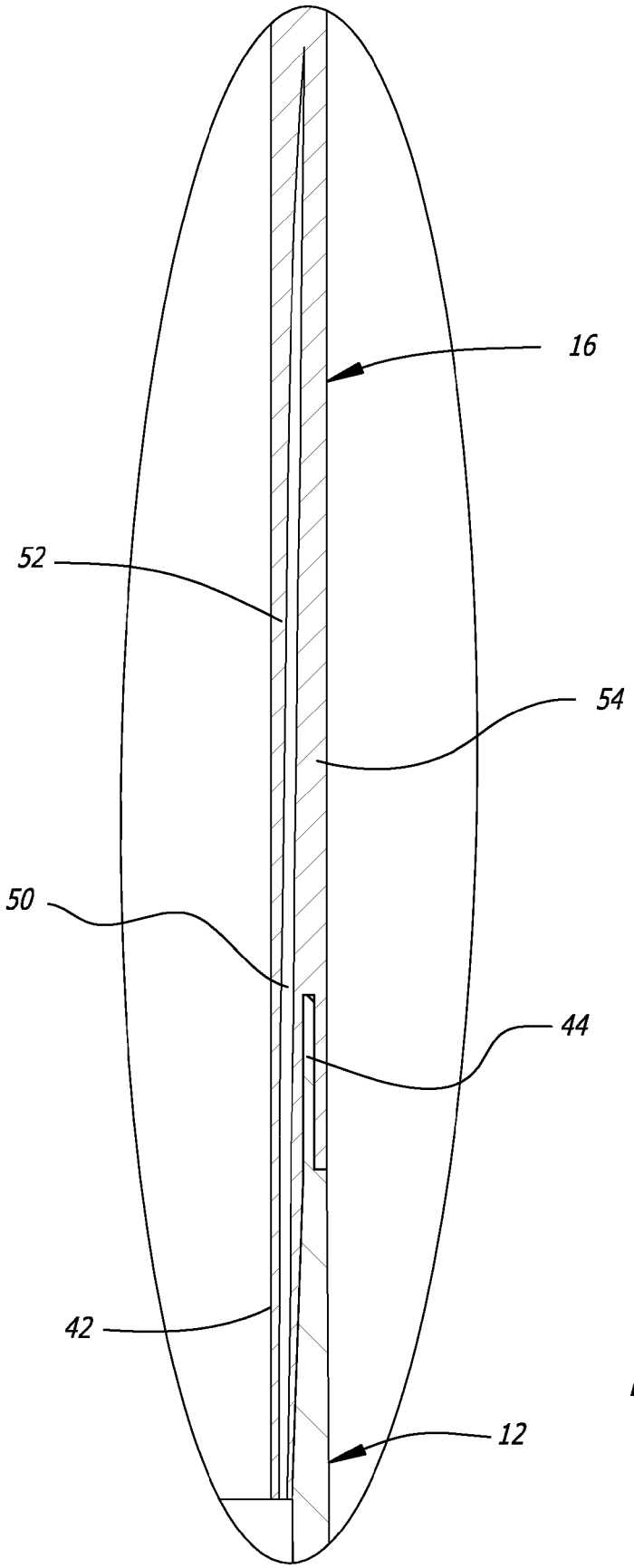
FIG. 8 is an enlarged cross-sectional view of area "8", illustrating the interconnection of the barrel and the end cap, in accordance with the present invention.

The region immediately adjacent to the end 42 of the end cap 16 is preferably also of a reduced diameter so as to be inserted into the end 44 of the barrel 12, as illustrated in FIG. 8, so as to overlap somewhat with the barrel 12.

With reference now to FIGS. 5 and 8, similar to the handle 14, the end cap 16 includes a gap or void 48 formed within the wall 50 so as to create multiple walls 52 and 54 on either side of the gap or void 48. The gap or void 48 may be formed in a variety of manners, including applying a release layer or a scrim or the like between layers forming the wall 50 so as to create the void or gap 48 therein, and a multi-wall configuration, comprising walls 52 and 54 on either side of the gap or void 48. Preferably, this gap or void 48 extends from the first end 42 of the end cap 16 along a length thereof towards the opposite end. Similar to the handle section 14, the gap or void 48 formed within the wall 50 so as to create multiple walls, or in other words a multi-wall configuration, can vary in length. As illustrated, the gap or void 48 extends substantially the length of the end cap. However, it will be appreciated that the length of the multi-wall section or one or more gaps or voids 48 formed within the wall 50 can be of a lesser length, such as several inches in length, or even less than an inch in length. Alternatively, as illustrated, the gap or void 48 may be formed within substantially the entire length of the wall 50 so as to create multiple walls 52 and 54 on either side of the gap or void 48 along substantially the length of the end cap 15. The multi-wall configuration is generally annular in configuration. As illustrated in FIG. 8, after the interconnection of the barrel 12 to the end cap 16, the portion of the end cap 16 having a multi-wall configuration preferably overlaps somewhat with the second end 44 of the barrel section 12.

Once again, the creation of the gap or void 48 and the accompanying multi-wall configuration region of the end cap 16 creates an area having a trampoline effect or an enlarged effective hitting area which extends from the barrel 12 into the end cap 16 where the multi-wall configuration extends. Normally, if a ball were to be struck outside the barrel, it would be outside of the sweet spot or effective hitting area. However, if a batter hits a ball at the end cap section where the multi-wall configuration is, the ball will be hit more effectively than the portion of the end cap 16 which does not have the multi-wall configuration.

When the bat 10 has a multi-wall configuration at the region of the second end 24 of the handle 14 and the first end 42 of the end cap 16, the sweet spot or effective hitting area is greatly enlarged in size or length along the bat 10 to encompass not only the barrel section 12 but also the portions and regions of the handle 14 and end cap 16 having the multi-wall configuration due to the presence of the gaps or voids. Thus, for example, the sweet spot or effective hitting area may be tripled in size.

Although the bat 10 may include a separate end plug or cap disposed at the second end of the barrel 16, in the illustrated preferred embodiment, the "cap" 56 is formed of a composite material of a single piece construction during the construction of the barrel 16, by simply molding or otherwise forming the cap segment 56 into the end cap section 16. This may be done, for example, by depressing an end of the wall forming the barrel section 16 inwardly, as illustrated in FIG. 5, so as to effectively create an end plug or cap formed integrally with the end cap section 16.

With reference again to FIGS. 1 and 6, it will be appreciated that the lengths of the handle section 14, the intermediate tapered region 26, the barrel 12 and the end cap section 16 can be varied. For example, the length of the intermediate tapered region or section 26, which is typically part of the handle section 14 may be based upon the size and type of bat, such as taking into account adult baseball bats, youth baseball bats, softball bats, etc.

The knob 18 may be attached to the first end 20 of the handle section 14 by any appropriate means, including, without limitation, bonding agents, glues, adhesives or the like. The knob 18 may be made of various materials including, without limitation, aluminum, polyurethane, polycarbonate, a composite material, plastic or the like. As described above, the gripping region 22 of the handle section 14 may be wrapped or overlaid with a cushion and a gripping surface for the user, which may be comprised of a rubber, polyurethane, leather, etc.

Figure 9A:
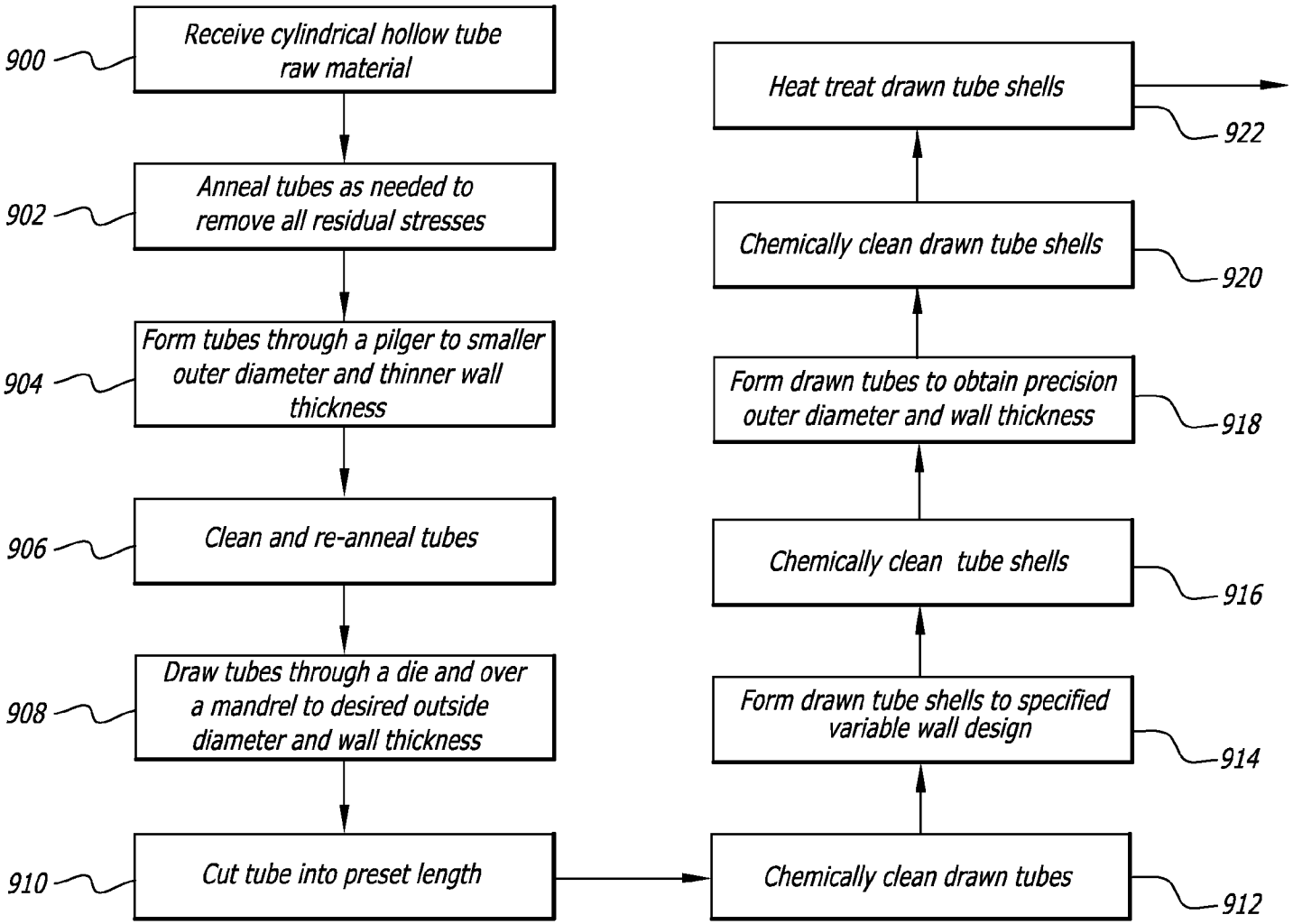
FIGS. 9A and 9B are flow charts illustrating the steps taken in accordance with creating a barrel section of the bat, in accordance with the present invention.
Figure 9B:
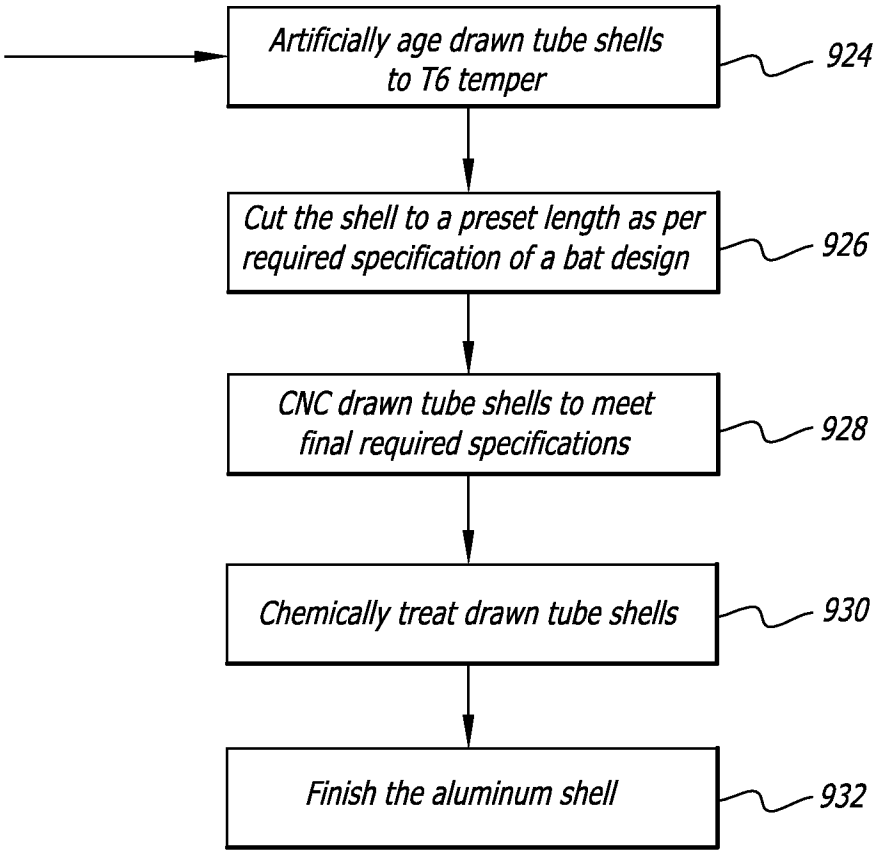

With reference now to FIGS. 9A and 9B, the steps taken in creating a barrel which can be incorporated into an embodiment of the present invention are shown. Cylindrical hollow tubes of the raw material are received 900. These are typically cylindrical hollow tubes of metal in annealed or fabricated condition. The tubes are annealed as needed to remove residual stresses 902. The tubes are then formed through a pilger to smaller outer diameter and thinner wall thicknesses 904, depending upon the desired characteristics of the bat. The tubes are then cleaned and re-annealed 906. The tubes are then drawn through a die and over a mandrel to a desired outer diameter and wall thickness 908. The tubes are then cut into a preset length 910.

The drawn tubes are then chemically cleaned 912 and then formed to a specified variable wall design 914. A series of draws may be used to form variable wall thickness in a rough condition as required by the design. The tube shells are then chemically cleaned again 916, and the drawn tubes are formed to obtain precision outer diameter and wall thickness

918. This is a final draw to form precise variable wall thickness as per the required design. At this point, for example, the final thickness of the barrel section 12 will be formed, including the reduced diameter end sections 36 and 44.

The drawn tube shells are chemically cleaned again 920, and heat treated 922. The drawn tube shells are then artificially aged to a desired temper 924. Such temper may be, for example, a T6 temper.

The shell is then cut to a preset length as per the required specification of the bat design 926, and the drawn tube shells are passed through a CNC process to meet final required specifications 928. The drawn tube shells are then chemically treated again 930 and finished 932. It will be understood that aluminum or aluminum metal alloy is a particularly desirable metal for use with the barrel, although other metal alloys and materials are contemplated by the present invention.

Figure 10:
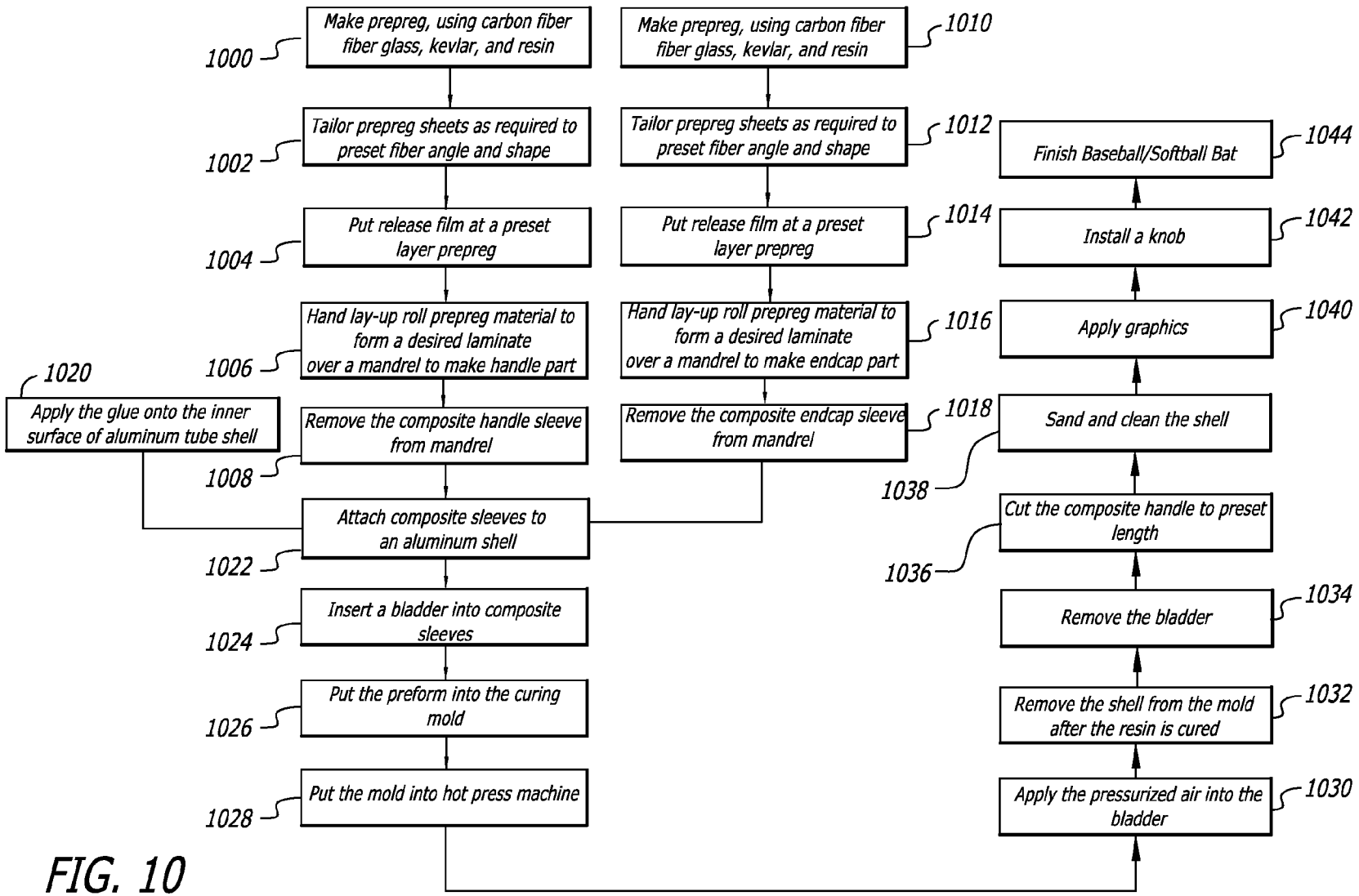
FIG. 10 is a flow chart depicting the steps taken in conjunction with the creation of the handle and end cap sections and the assembly of the bat.

With reference now to FIG. 10, pre-preg (pre-impregnated composite fibers or sheets) are made using carbon fiber, fiberglass, Kevlar, resin, etc. 1000 as needed or obtained from outside sources. The pre-preg sheets are tailored as required to preset fiber angle and shape 1002. This typically involves cutting the pre-preg material into predetermined shapes and angles that is required by the given bat design.

In the illustrated embodiment, a release film is placed at a preset layer of the pre-preg 1004 to create the gap or void within the multi-layer wall of the composite material. Where the release film is placed, the layers will separate apart from one another during the manufacturing process in order to create the desired gap or void, and separate the wall into a multi-wall configuration at that region.

The pre-preg material is hand laid and rolled to form a desired laminate over a mandrel to make the handle section 1006. The number of layers may vary from location to location on the mandrel as per the specified features of the handle section design. The resulting composite sleeve is then removed from the mandrel 1008.

Similar steps are taken in constructing the end cap section. Pre-pregs are made using carbon fiber, fiberglass, Kevlar, resin, etc. 1010. The pre-preg sheets are tailored as required to preset fiber angle and shape according to the design 1012. A release film is placed at a preset layer of the pre-preg 1014 to create the gap or void in the end cap, as discussed above. The pre-preg material is hand laid and rolled to form a desired laminate over a mandrel 1016 to make the end cap part. The composite end cap sleeve is removed from the mandrel 1018 after these steps are completed.

A metal tube shell formed in accordance with the process of FIGS. 9A and 9B has glue applied to the inner surface thereof 1020, and the composite sleeves of the handle section and the end cap section are attached to the shell 1022. This may be, for example, by inserting the reduced ends of the composite end cap and handle section sleeves into the opposite ends of the barrel section, as illustrated and described above.

A bladder is then inserted into the composite sleeve 1024. The preform consisting of the aluminum tube shell and sleeves is then put into a curing mold 1026. The mold is put into a hot press machine 1028 and pressurized air is applied to the bladder 1030.

After the resin is cured, the shell, having the handle and end cap sleeves or sections attached thereto is removed from the mold 1032. The bladder is also removed 1034. The composite handle is cut to the preset length 1036. The shell or bat is then sanded and cleaned 1038, graphics applied thereto 1040, and a knob installed 1042 and otherwise finished 1044 to create the baseball or softball bat. The graphics and decorations may include paint, chrome, powder-coating, or other methods of decorative coating and/or labels and the like. The graphics may be created by heat transferring, pad stamping, silk screening, etc.

It will be understood by those skilled in the art that the bat 10 of the present invention may be manufactured and assembled in a number of ways, and it is to be understood that the following methods may be altered in some respects while still creating a bat 10 having the desired characteristics. Also, certain dimensions, materials, temperatures, etc. may be altered depending upon the size, weight and intended use of the resulting bat 10 such as for baseball, softball, etc.

Although several embodiments have been described in detail for purposes of illustration, various modifications may be made without departing from the scope and spirit of the invention. Accordingly, the invention is not to be limited, except as by the appended claims.

What is claimed is:

1. A baseball or softball bat, comprising:

a barrel having opposite first and second ends;

a handle having a first end defining a grip portion and a generally opposite second end including an annular recess configured to receive the first end of the barrel therein, and at least a portion of the handle having a multi-wall configuration defined by a gap formed between layers of material comprising the handle; and an end cap having a first end attached to the second end of the barrel;

wherein the gap in the portion of the handle having the multi-wall configuration is generally annular and is disposed adjacent to the second end of the handle so as to be generally concentric with the annular recess of the handle.

2. The baseball or softball bat of claim 1, wherein at least a portion of the end cap has a multi-wall configuration defined by a gap.

3. The baseball or softball bat of claim 2, wherein the gap in the portion of the end cap having the multi-wall configuration is generally annular in configuration and disposed adjacent to the first end of the end cap.

4. The baseball or softball bat of claim 1, wherein a portion of the end cap adjacent to the first end thereof is insertable into the second end of the barrel such that the end cap and barrel are coaxial.

5. The baseball or softball bat of claim 1, wherein the first end of the end cap and the second end of the barrel are of reduced outer diameter, such that interconnection of the end cap and barrel provides a generally continuous exterior surface.

6. The baseball or softball bat of claim 2, wherein the end cap includes an annular recess configured to receive the second end of the barrel therein.

7. The baseball or softball bat of claim 1, wherein a portion of the handle adjacent to the second end thereof is insertable into the first end of the barrel such that the handle and barrel are coaxial.

8. The baseball or softball bat of claim 1, wherein the second end of the handle and the first end of the barrel are of reduced outer diameter, such that interconnection of the handle and barrel provides a generally continuous exterior surface.

9. The baseball or softball bat of claim 1 or 2, wherein the barrel is comprised of a metal or a composite material.

10. The baseball or softball bat of claim 1, wherein the handle is comprised of a multi-layer composite material, and the gap in a wall of the handle is formed between layers of the composite material.

11. The baseball or softball bat of claim 2, wherein the end cap is comprised of a multi-layer composite material, and the gap in a wall of the end cap is formed between layers of the composite material.

12. A baseball or softball bat, comprising:

a barrel having opposite first and second ends;

a handle comprised of a multi-layer composite material and having a first end defining a grip portion and a generally opposite second end including an annular recess configured to receive the first end of the barrel therein, and at least a portion of the handle having a multi-wall configuration defined by a gap formed between layers of the composite material comprising the handle; and an end cap comprised of a multi-layer material and having a first end including an annular recess configured to receive the second end of the barrel therein, and at least a portion of the end cap having a multi-wall configuration defined by a gap formed between layers of the composite material comprising the end cap;

wherein the gap in the portion of the handle having the multi-wall configuration is generally annular in configuration and disposed adjacent to the second end of the handle and generally concentric with the annular recess of the handle; and wherein the gap in the portion of the end cap having the multi-wall configuration is generally annular and is disposed adjacent to the first end of the end cap and generally concentric with the annular recess of the end cap.

13. The baseball or softball bat of claim 12, wherein the barrel is comprised of a metal or a composite material.

14. The baseball or softball bat of claim 12, wherein a portion of the handle adjacent to the second end thereof is insertable into the first end of the barrel such that the handle and the barrel are coaxial.

15. The baseball or softball bat of claim 12, wherein the second end of the handle and the first end of the barrel are of reduced outer diameter, such that interconnection of the handle and the barrel provides a generally continuous exterior surface.

16. The baseball or softball bat of claim 12, wherein a portion of the end cap adjacent to the first end thereof is insertable into the second end of the barrel such that the end cap and the barrel are coaxial.

17. The baseball or softball bat of claim 12, wherein the first end of the end cap and the second end of the barrel are of reduced outer diameter, such that interconnection of the end cap and the barrel provides a generally continuous exterior surface.

* * * * *